United States Patent [19]

Walls

[11] 4,239,208

[45] Dec. 16, 1980

[54] WRIST AND FOREARM CONDITIONER AND EXERCISER

[76] Inventor: Billy D. Walls, Box J, Mondamin, Iowa 51557

[21] Appl. No.: 946,120

[22] Filed: Sep. 27, 1978

[51] Int. Cl.[3] ..... A63B 21/00

[52] U.S. Cl. ..... 272/67; 272/142; 272/140

[58] Field of Search ..... 272/140, 136, 135, 67, 272/68, 117, 130, 142; 128/26; 273/54 B, 108

[56] References Cited

U.S. PATENT DOCUMENTS

| | | | |
|---|---|---|---|
| 481,730 | 8/1892 | Miller | 272/136 |
| 3,606,343 | 9/1971 | Lemon | 273/54 B |
| 3,747,925 | 7/1973 | Seeger | 272/140 |

FOREIGN PATENT DOCUMENTS

| | | | |
|---|---|---|---|
| 436523 | 10/1935 | United Kingdom | 273/108 |

*Primary Examiner*—Richard C. Pinkham
*Assistant Examiner*—William R. Browne
*Attorney, Agent, or Firm*—Hiram A. Sturges

[57] ABSTRACT

A wrist and forearm conditioner and exerciser useful for conditioning and strengthening the wrist and forearm for such activities as golf, tennis and handball, thereby decreasing the susceptibility to the condition called "tennis elbow". The exercise comprises a handle similar to that of a tennis racquet attached to a handle carrier, a frame rotatably mounting the carrier on a wall, and a resilient member mounted on the frame and tensioned increasingly by the carrier as the handle is rotated.

13 Claims, 4 Drawing Figures

WRIST AND FOREARM CONDITIONER AND EXERCISER

BACKGROUND OF THE INVENTION

Many people need the exercise that provides pronation and supination of the forearm so as to reduce the incidence of a condition which is commonly called "tennis elbow."

I have not seen an exerciser on the market for this purpose and so it is an object of this invention to provide such an exerciser made in a simple and inexpensive way for mass-affordability.

A second objective is to provide an exerciser which can be easily repaired and more particularly one which uses an inexpensive elongated heavy rubber band for providing the resistance to the exercise and in which the rubber band can be replaced if necessary by mounting it in a box having a removable cover.

SUMMARY OF THE INVENTION

A particular goal of this invention is to provide a wrist and forearm conditioner and exerciser useful for conditioning and strengthening the wrist and forearm thereby resisting the condition called "tennis elbow" and furthermore strengthening and conditioning such anatomy for other sporting activities such as golf and handball and comprising a handle similar to that of a tennis racquet attached to a handle carrier, a frame rotatably mounting said carrier to a wall, and resilient means mounted on the frame and tensioned increasingly by the carrier as the handle is rotated.

A further object is to provide the handle of the exerciser with a slippage resistant covering similar to the coverings used on tennis racquets so that the operator's hand will not tend to slip with respect to the handle as the handle is rotated under high tension.

Yet another goal is to provide a pivoting connection between the handle and the carrier so that the handle can be placed in a vertical position for compact storage and then moved to a horizontal position for use.

DESCRIPTION OF THE PREFERRED EMBODIMENT

Figure 1:
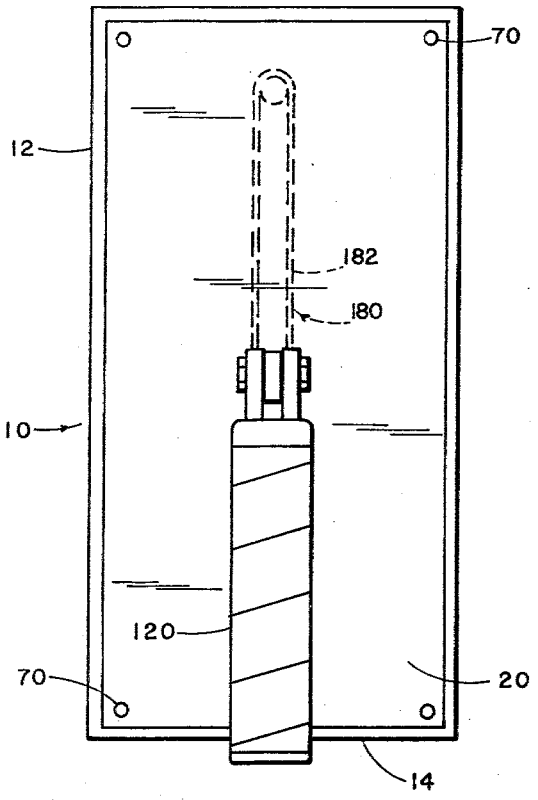
FIG. 1 is a frontal elevation of the conditioner and exerciser with the cover on and the handle shown in a vertical storage position, the positions of some parts being shown in dotted lines including a part of a rubber band, a post and forward parts of the carrier. The handle in FIG. 1 is in vertical position for storage.

The wrist and forearm conditioner and exerciser of this invention is generally indicated at 10 in FIG. 1, and comprises a frame 12 in the form of a box having a forward portion 14 and a cover 20.

Figure 2:
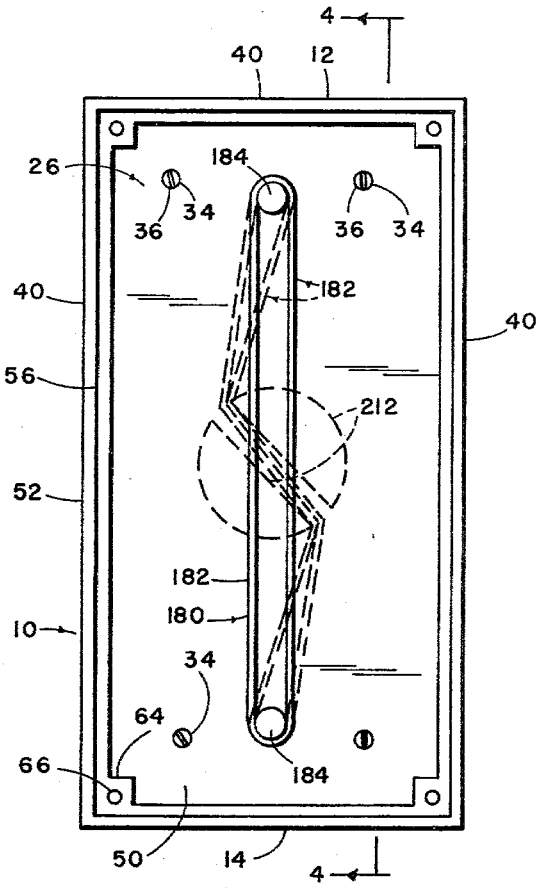
FIG. 2 is a frontal elevation of the wrist and forearm conditioner and exerciser of this invention shown with its cover and handle and handle carrier removed with the exception that forward portions of the carrier are shown in dotted lines in a position in which a rubber band has been twisted out of rest position by rotation of the carrier, the rest position of the band being shown in full lines and the biased position being shown in dotted lines.

The forward portion 14 of the frame is best seen in FIG. 2 and comprises a forward wall 26 which can be disposed with its flat forward surface 32 in a vertical position against the vertical wall, not shown, to which it can be secured by screws or bolts extending through bolt holes 36 extending horizontally through the forward wall 26.

The forward frame portion 14 has side walls 40 on its top, bottom and vertical sides and these can be arranged in the form of a rectangle surrounding a hollow interior 50.

The side walls 40 form a rectangular side wall assembly and can be of one piece with the forward wall 26.

Figure 4:
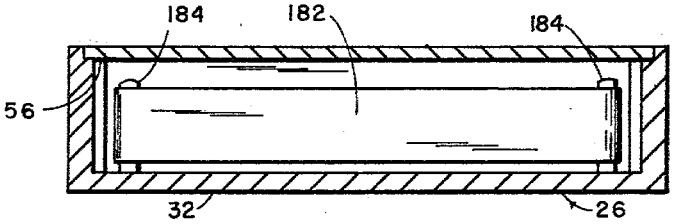
FIG. 4 is a sectional view of the conditioner and exerciser as it would be seen along the line 4—4 of FIG. 2 with the rubber band shown in rest position, with the cover placed on the forward part of a box thereof but with the handle and handle carrier not shown and bolts not shown.

The side wall assembly formed by the side walls 40 can be designated as a side wall assembly 52 and it will be seen to have a recess 56 on the rearward edges of each of the walls 40 which are farthest from the forward wall 26 for receiving in the recess 56 a cover plate or cover 20 which fits in the recess, as best seen in FIG. 4.

At each corner of the side wall assembly 52 the side walls have a portion 64 of extra thickness, each having a bolt hole 66 receiving a respective one of four bolts 70, extending through the cover 20, as best seen in FIG. 1, for holding the cover in place.

Figure 3:
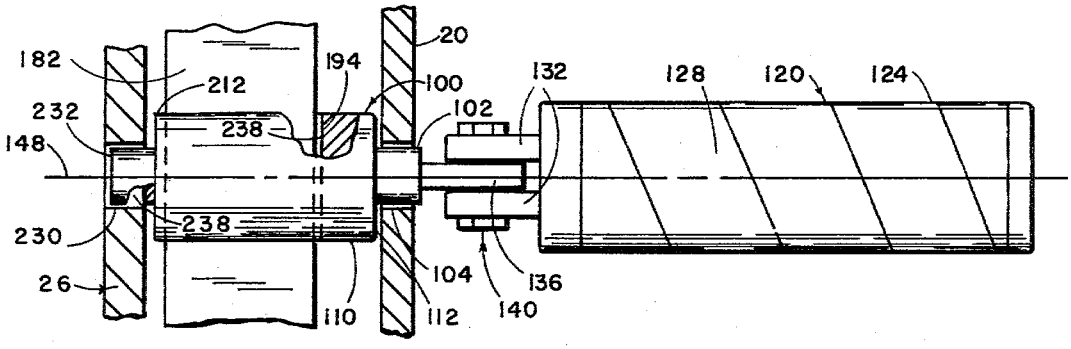
FIG. 3 is a detail showing the handle and carrier of the invention completely and as they would be seen in side elevation with the frame or box of the exerciser not being shown, with the exception of a portion of the cover being shown in section with the adjacent part of the cover removed, a portion of aurrber band being shown in position in the carrier. The handle in FIG. 3 is in horizontal position for use.

A handle carrier best seen in FIG. 3 at 100 is rotatably mounted on the frame 12 by having a cylindrical portion 102 thereof disposed through a cylindrical opening 104 extending horizontally through the cover 20. The carrier 100 has an enlarged portion 110 which provides a shoulder 112 on the side thereof which faces the cover 20, the shoulder 112 being larger than the opening 104 to retain the carrier 100 from moving outwardly through the cover 20.

A handle 120 is provided having an elongated outer surface 124 of a size for convenient grip such as the size in transverse cross section of a tennis racquet handle.

The handle 120 has its forward end mounted on the carrier 100 by means of having ears 132 projecting from the forward end of the handle 120 and the latter are spaced apart for receiving therebetween a tongue 136 fixed to the carrier 100 and projecting rearwardly therefrom. The tongue 136 is attached to the handle 124 further by means of a pivot bolt 140 extending through the ears 132 and through the tongue 140 in a horizontal direction whereby the handle 120 can be held in a horizontal position along the axis 148 of pivoting of the carrier 100.

But also the bolt 140 permits a pivoting of a handle 120 to a vertical position as shown in FIG. 1.

The resistance mentioned is provided by a resilient assembly generally indicated at 180 and preferrably comprising and endless rubber band 182 stretched across horizontal posts 184 which are fixed to and project rearwardly from the forward wall 26 of the box or frame 12.

With the post 184 arranged so that the band 182 is vertically elongated, the band is then received in a vertically elongated slot 194 extending through the carrier 100 vertically and opening from the forward end of the carrier inwardly and rearwardly, the slot 194 receiving a central portion of the rubber band 182 therein.

In operation, as the operator twists the handle for rotating the carrier 100, the band 182 becomes distorted from its rest position as shown in full lines in FIG. 2 into various biased positions, one of which is shown in dotted lines in FIG. 2 in a position for biasing the rubber band 182 so that twisting of the handle is resisted.

It will be seen that the more the twisting proceeds the greater the resistance provided by the band 182.

It will be seen that a twisting of the handle will create pronation and supination of the forearm to strengthen and condition the wrist and forearm by rotation in each of two opposite directions about the axle 148 in a manner providing great benefits, one of which is providing resistance to the condition known as "tennis elbow."

In FIG. 2, it can be seen that the forward wall 26 can have an opening 130 for receiving a two-part forward stub axle 232 of generally cylindrical shape and concentric about the axis 148, the forward stub axle 232 having two parts spaced apart by the rubber band slot 194.

The slot 194 extends to the forward end of the stub axle 232. The two parts of the stub axle 232 are attached to respective spaced forward side portions 212 of the carrier 100.

The stub axle 232 is snugly and rotatably carried in the opening 230 whereby the carrier 100 is supported at its forward stub axle 232 and at its cylindrical portion 102, earlier described, although the cylindrical portions 102 can also be called a forward stub axle portion of the carrier 100.

I claim:

1. A wrist and forearm conditioner and exerciser comprising a frame, a handle carrier rotatably mounted on said frame for rotation about an axis, a handle, means mounting said handle on said carrier, said handle being adapted to be gripped by an operator's hand and twisted for rotating said carrier, resilient means mounted on said frame, means interconnecting said carrier and said resilient means whereby when said handle is twisted and said carrier is rotated then said resilient means becomes increasingly tensioned as said carrier is increasingly rotated, said handle being sufficiently similar to a tennis racquet handle that said handle has such a size and shape that the average man when gripping said handle with one hand can have the majority of the length of his fingers and also a portion of the palm of his hand in engagement with and applying pressure on said handle at one time, said resilient means being of a strength providing sufficient resistance to handle rotation that substantial wrist and forearm exercise is provided for a person as he rotates said handle, said substantial exercise being measurable as being an amount reasonably to be expected to be useful in an exerciser to be repeatedly used for strengthening a person's wrist and forearm for such activities as golf, tennis and handball, said frame having holes through a portion thereof, said holes extending substantially parallel to said axis for assisting the mounting of said frame on a vertical wall, said frame enclosing said resilient means at times of use, said frame having a forward side, a rearward side, and right and left sides, and top and bottom sides, said handle permanently extending forwardly from said forward side of said frame.

2. The wrist and forearm conditioner and exerciser of claim 1 having said resilient means comprising an elongated resilient member formed of rubber, means anchoring the ends of said resilient member to said frame, said carrier having a slot therein extending transversely of said axis, said resilient member being received through said slot whereby as said carrier is rotated the walls of said slot engage said resilient member pressing said resilient member out of its position of rest.

3. The wrist and forearm conditioner and exerciser of claim 2 in which said resilient member comprises an endless band of rubber two sides of a central portion of which are disposed in said slot.

4. The wrist and forearm conditioner and exerciser of claim 1 in which said handle is elongated on its exterior and in which said means mounting said handle on said carrier permits the elongation of said handle to be disposed along said axis whereby said handle can be disposed extending horizontally when said axis is horizontal so that said handle can be twisted about said axis with respect to said frame.

5. The wrist and forearm conditioner and exerciser of claim 4 in which said means mounting said carrier on said frame comprises a carrier opening in said cover through which a portion of said carrier is rotatably received.

6. The wrist and forearm conditioner and exerciser of claim 1 in which said frame comprises a box having a forward cover adjacent said handle and having a rearward portion, said rearward portion of said box having side walls cooperative with said cover for covering said resilient means from view from the sides and front of said box, means attaching said cover to said rearward portion of said box.

7. The wrist and forearm conditioner and exerciser of claim 6 in which said means attaching said cover to said box provides a removable attachment for providing access to said resilient means for repair purposes.

8. The wrist and forearm conditioner and exerciser of claim 1 in which said frame comprises forward and rearward portions having openings therethrough in alignment along said axis and said carrier has stub axle means rotatably received in said forward and rearward openings.

9. The wrist and forearm conditioner and exerciser of claim 8 in which said forward and rearward portions of said frame define a box having forward and rearward walls in which said opening receiving said stub axle portions are respectively mounted.

10. The wrist and forearm conditioner and exerciser of claim 1 in which said handle has two ends, said means attaching said handle being attached to one end of said handle, the other end of said handle being a terminal end.

11. The wrist and forearm conditioner and exerciser of claim 1 in which said handle is elongated between its said ends, said means attaching said handle permitting said handle to be placed in positions extending at various acute angles with respect to said axis.

12. The wrist and forearm conditioner and exerciser of claim 1 in which said elongated handle is disposable in a position extending substantially in alignment with said axis.

13. The wrist and forearm exerciser of claim 1 having securing devices in said holes.

* * * * *